United States Patent [19]

Moate

[11] Patent Number: 4,721,042

[45] Date of Patent: Jan. 26, 1988

[54] MISSILES WITH ANNULAR FLARE

[75] Inventor: Richard P. Moate, Stevenage, United Kingdom

[73] Assignee: British Aerospace PLC, London, England

[21] Appl. No.: 925,236

[22] Filed: Oct. 31, 1986

[30] Foreign Application Priority Data

Oct. 31, 1985 [GB] United Kingdom ..... 8526849

[51] Int. Cl.[4] ..... F42B 4/26

[52] U.S. Cl. ..... 102/343; 102/349; 102/358

[58] Field of Search ..... 102/336, 342, 343, 351, 102/352, 360, 349, 358

[56] References Cited

U.S. PATENT DOCUMENTS

| | | | |
|---|---|---|---|
| 2,926,606 | 3/1960 | Bangs et al. | 102/34.5 |
| 2,986,999 | 6/1961 | Fiedler et al. | 102/87 |
| 3,680,484 | 8/1972 | Stetter | 102/49 |
| 3,706,283 | 12/1972 | Bouisse et al. | 102/87 |
| 3,820,462 | 6/1974 | Jackson, Jr. | 102/351 X |
| 3,855,930 | 12/1974 | Mulich et al. | 102/351 X |
| 3,981,241 | 9/1976 | Ambrosini et al. | 102/347 X |
| 4,005,656 | 2/1977 | Gellerstedt et al. | 102/340 |
| 4,164,186 | 8/1979 | Beatty et al. | 102/341 |
| 4,250,705 | 2/1981 | Zante et al. | 102/352 X |
| 4,389,938 | 6/1983 | Sigrist | 102/340 X |

*Primary Examiner*—Peter A. Nelson

*Attorney, Agent, or Firm*—Cushman, Darby & Cushman

[57] ABSTRACT

A missile includes an annular flare element 18 which is housed between the outer skin of the missile and the propulsion nozzle 14. The flare element allows the propulsion efflux to be as fully expanded as possible while still providing a large area of flare.

5 Claims, 3 Drawing Figures

MISSILES WITH ANNULAR FLARE

BACKGROUND OF THE INVENTION

This invention relates to missiles including a pyrotechnic flare.

In many missile systems the missile includes a pyrotechnic flare to enable it to be tracked and in a conventional system the flare comprises several solid cylindrical plugs of pyrotechnic material equispaced around the outlet nozzle of the motor. In this arrangement however, the plugs of pyrotechnic material reduce the maximum possible diameter of the outlet nozzle. Particularly in missiles intended to travel at high speeds, it is desirable for the efflux from the nozzle to be as fully expanded as possible to maximise the boost motor performance in terms of total energy for a given mass.

SUMMARY OF THE INVENTION

According to one aspect of this invention, there is provided a missile including a body, a propulsion motor mounted within said body, a propulsion nozzle located in a rearward region of said body for exhausting propulsion efflux rearwardly, and a flare element of pyrotechnic material and of generally annular cross section located within said body and surrounding said propulsion nozzle.

By this arrangement the flare element generates a large image but allows the outlet area of the missle nozzle to be relatively large.

BRIEF DESCRIPTION OF THE DRAWINGS

Further aspects will become apparent from the following description which is by way of example only, in which reference will be made to the accompanying drawings, in which.

DESCRIPTION OF A PREFERRED EMBODIMENT

Figure 1:
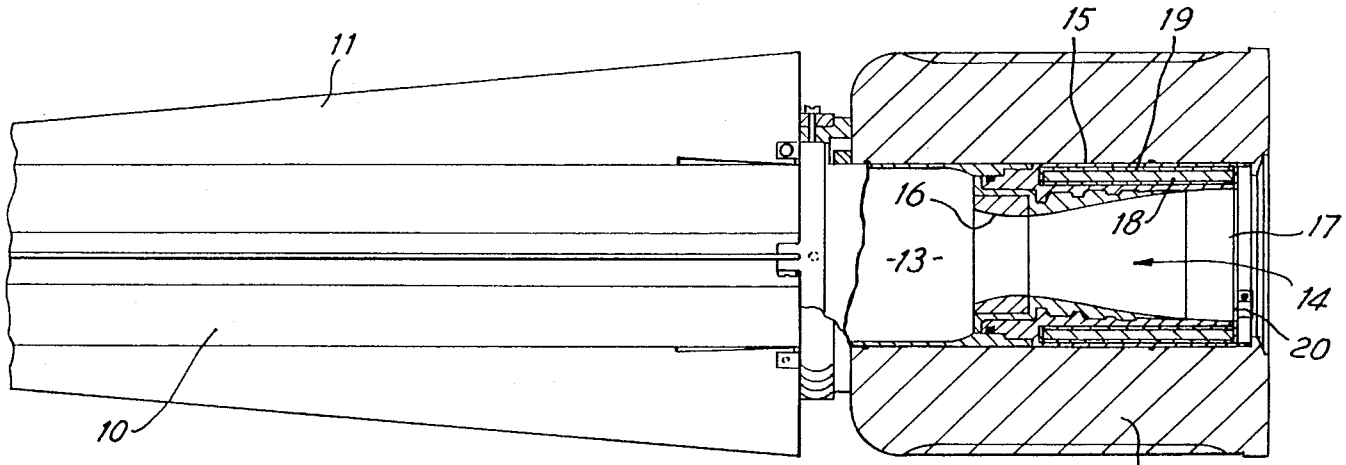
FIG. 1 is a section view through the rear portion of a missile incorporating a pyrotechnic flare.
Figure 3:
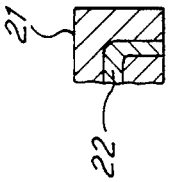
FIG. 3 is a detail section view on part of the igniter assembly of the missile.
Figure 2:
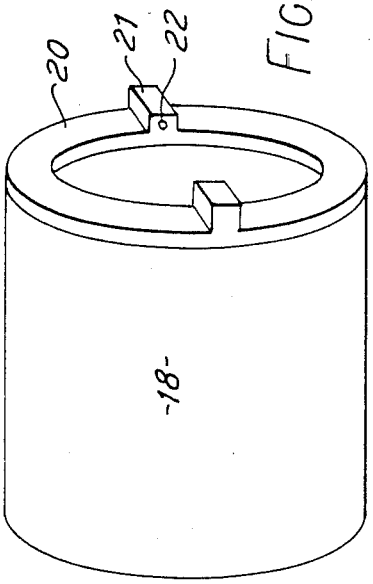
FIG. 2 is a general perspective view of the flare in the missile.

The missile illustrated is tracked following launch by an autotracker tracking a pyrotechnic flare, and includes an expulsion motor of the type described in copending application Pat. No. 925,235 filed concurrently herewith and assigned to the same assignee.

Referring to the drawings, the missile includes a body 10, four equally spaced chamfered fins 11 adapted to maintain the missile in a state of spin following launch and an expulsion motor 12 releasably attached to the missle by four nylon shear screws (not shown).

The missle includes a boost motor 13 and an associated boost outlet nozzle 14 located within a rearward portion of the body 10 and surrounded by the external skin 15 of the missile. The nozzle includes a throat 16 and an outlet aperture 17. In order to extract the maximum amount of energy from the propellant charge contained in the missile motor it is desirable to have as large an aperture as possible so that efflux from the nozzle is as fully expanded as possible as it leaves the nozzle.

Located between the external surface of the nozzle case and the internal surface of the missile skin 15 is a cavity of generally annular cross-section in which a flare element 18 is located. An insulating liner 19 separates the flare pyrotechnic mixture from the missile skin and motor nozzle surfaces during missile flight to protect these from the burning flare material. No separate flare casing is employed, the flare pyrotechnic mixture being inserted directly into the cavity thereby achieving significant weight savings.

An end cap 20 is attached to the rear end face and includes two lugs 21 projecting rearwardly. The two lugs 21 constitute parasitic igniters, including a right angled passage containing a length of igniter cord 22 having one end adjacent the outlet aperture of the boost motor nozzle and exposed to the boost motor efflux on ignition thereof and the other end adjacent the pyrotechnic material of the flare.

On launch of the missile, the expulsion motor carries the missile a safe distance away from the launch site, and the boost motor is then ignited. On ignition of the boost motor, the boost efflux jettisons the expulsion motor and ignites the pyrotechnic flare via the parasitic igniters.

I claim:

1. A self-propelled missile for being tracked following launch, comprising:

a main body portion;

a propulsion motor housed within said main body portion;

a propulsion efflux outlet disposed in an aft portion of the body portion on the longitudinal axis of the missile and arranged to exhaust propulsion efflux rearwardly; and an annular flare surrounding the propulsion efflux outlet and extending coaxially with respect to said longitudinal axis, said flare including an annular element of pyrotechnic material and an annular outlet for exhausting pyrotechnic efflux rearwardly.

2. A missile according to claim 1, wherein said flare element includes igniter means adapted to be ignited by the efflux exhausting through said propulsion nozzle.

3. A missle according to claim 1, wherein said flare element is formed by packing a pyrotechnic mixture into an annular cavity between the outer surface of the missile and the propulsion nozzle.

4. A self-propelled missile for being tracked following launch, comprising:

a main body portion;

a propulsion motor housed within said main body portion;

a propulsion efflux outlet disposed in an aft portion of the body portion on the longitudinal axis of the missle and arranged to exhaust propulsion rearwardly;

an annular flare surrounding the propulsion efflux outlet and extending coaxially with respect to said longitudinal axis, said flare including an annular element of pyrotechnic material and an annular outlet for exhausting pyrotechnic efflux rearwardly; and an expulsion motor of annular cross-section surrounding said aft portion of said missile and including means for releasably coupling said expulsion motor to said main body portion to be jettisoned on ignition of said propulsion motor.

5. A self-propelled missilie for being tracked following launch, comprising:

a main body portion;

a propulsion motor housed within said main body portion;

a propulsion efflux outlet of convergent divergent form disposed in an aft portion of the missile on the longitudinal axis of the missile and arranged to exhaust propulsion efflux rearwardly, said outlet being selected having regard to the propulsion motor such that said efflux is substantially fully expanded; and an annular flare surrounding the propulsion efflux outlet and extending coaxially with respect to said longitudinal axis, said flare including an annular element of pyrotechnic material and an annular outlet for exhausting pyrotechnic efflux rearwardly.

* * * * *